US007389624B2

(12) United States Patent
Henry et al.

(10) Patent No.: US 7,389,624 B2
(45) Date of Patent: Jun. 24, 2008

(54) METHOD AND DEVICE FOR CONTROLLING ENVELOPE FLAP DURING INSERTION

(75) Inventors: Bradford D. Henry, Cary, NC (US); Frank Shinn, Fuquay-Varina, NC (US)

(73) Assignee: Bowe Bell + Howell Company, Durham, NC (US)

( * ) Notice: Subject to any disclaimer, the term of this patent is extended or adjusted under 35 U.S.C. 154(b) by 0 days.

(21) Appl. No.: 10/823,787

(22) Filed: Apr. 14, 2004

(65) Prior Publication Data

US 2005/0050862 A1 Mar. 10, 2005

Related U.S. Application Data

(60) Provisional application No. 60/462,320, filed on Apr. 14, 2003.

(51) Int. Cl.
*B65B 43/26* (2006.01)

(52) U.S. Cl. ..... 53/381.5; 53/381.7; 53/569; 53/460

(58) Field of Classification Search ..... 53/381.5, 53/381.7, 381.1, 569, 460, 206; 493/245, 493/453

See application file for complete search history.

(56) References Cited

U.S. PATENT DOCUMENTS 2,001,009 A 5/1935 Baker et al.
2,746,221 A * 5/1956 Rouan et al. ..... 53/460
3,935,800 A * 2/1976 Sette et al. ..... 493/465
3,974,749 A * 8/1976 Luperti et al. ..... 493/465
4,020,615 A * 5/1977 Irvine et al. ..... 53/473
4,333,300 A * 6/1982 Russell ..... 53/569
4,499,705 A 2/1985 Russell
4,525,986 A * 7/1985 Noll ..... 53/569
4,527,378 A * 7/1985 Russell ..... 53/284.3
4,781,013 A * 11/1988 DePasquale et al. ..... 53/569
4,798,040 A * 1/1989 Haas et al. ..... 53/460
5,156,585 A * 10/1992 Dimur et al. ..... 493/409
5,457,941 A * 10/1995 Long et al. ..... 53/460
5,487,254 A * 1/1996 Dronsfield ..... 53/381.7
5,560,185 A * 10/1996 Petkovsek ..... 53/460
5,675,959 A * 10/1997 Hamma et al. ..... 53/381.1
5,715,648 A * 2/1998 Yates ..... 53/381.5
5,911,668 A 6/1999 Auerbach et al.
5,992,132 A * 11/1999 Auerbach ..... 53/569
6,293,076 B1 9/2001 Miller et al.
6,453,651 B1 * 9/2002 Werner ..... 53/569

FOREIGN PATENT DOCUMENTS

EP 1 219 455 A1 7/2002

OTHER PUBLICATIONS

EP Search Report for Appln. No. 04252145.0-2304, dated Oct. 17, 2007.

* cited by examiner

*Primary Examiner*—Sameh H. Tawfik
(74) *Attorney, Agent, or Firm*—McDermott Will & Emery LLP

(57) ABSTRACT

A high-speed envelope transport and packing system includes a conveyor for conveying an open envelope having a flap, a packing station for inserting an object into a conveyed open envelope, and a bending member disposed upstream of the packing station. The bending member is configured to impart a bend in a conveyed open envelope by displacing a center portion of the envelope relative to widthwise distal end portions of the envelope and to maintain a bend in the envelope until the open envelope is gripped by a gripping device in such a manner as to provide access to an interior of the open envelope or until an object is at least partially inserted into an interior of the open envelope.

26 Claims, 7 Drawing Sheets

METHOD AND DEVICE FOR CONTROLLING ENVELOPE FLAP DURING INSERTION

CROSS REFERENCE TO RELATED APPLICATIONS

This application claims priority from and is related to U.S. Provisional Application No. 60/462,320, filed Apr. 14, 2003, entitled "METHOD AND DEVICE FOR CONTROLLING ENVELOPE FLAP DURING INSERTION", by inventors Bradford D. Henry et al. The contents of the provisional application are hereby incorporated by reference in its entirety.

TECHNICAL FIELD

The technical subject matter relates generally to high speed envelope transport and packing systems and, more specifically, to a method and device for controlling an envelope flap during packing.

BACKGROUND OF THE INVENTION

As schematically illustrated in FIG. 1, in conventional envelope transport and packing system 40, an envelope 4 is transported from a feeder apparatus 42 by an intermediate conveyor 50 to an envelope packing assembly 44. The envelope 4 is then packed with an insert 46 at the envelope packing assembly 44 and exited to an exiting conveyor 48. The exiting conveyor 48 then seals the flap 8 of the packed envelope 4 and transports the envelope 4 out of the system 40.

A typical envelope 4 of the type used in an envelope packing system is illustrated in FIG. 2. The envelope 4 comprises an envelope body 6 and a flap 8. The flap 8 is connected to the envelope body 6 at a connecting edge 10, and the connecting edge 10 of the envelope body 6 defines a crease formed by folding the envelope flap 8 over the envelope body 6. The envelope body 6 comprises an envelope front wall 12 and an envelope back wall 14. The envelope front wall 12 and back wall 14 are connected at three sides but left unconnected at a side adjacent the connecting edge 10 to form an envelope opening 16. The connected side opposite the envelope opening 16 is an envelope bottom 18, and the two other connected sides are envelope sides 20.

As used herein, a flap-closed configuration occurs when the flap 8 of the envelope 4 is folded along the connecting edge 10 and resting over the envelope body 6. In a flap-open configuration, the flap 8 of the envelope 4 is rotated away from the envelope body 6. Because envelopes are typically sold in a flap-closed configuration for packaging and shipping efficiency, many conventional envelope packing systems are configured to accept envelopes in the flap-closed configuration. As part of the packing process, a flap opening means rotates the flap 8 of the envelope 4 from the flap-closed configuration to the flap-open configuration.

One type of flap opening means uses a jet of air directed towards the flap 8 to rotate the flap into the flap-open configuration. The envelope flap 8, although held in the flap-open configuration by the flap opening means, retains a bias to return to the flap-closed configuration due the crease in the envelope running along the connecting edge 10 of the envelope body 6. However, when the envelope is introduced into a conveyor for subsequent processing and after the connecting edge 10 of the envelope body 6 passes between various feeding mechanisms, such as rollers, the crease in the envelope 4 is substantially flattened, which tends to bias the envelope flap 8 towards the flap-open configuration.

Once the envelope 4 has been conveyed to the packing phase of the envelope packing system, controlling the location of the envelope flap 8 is important to prevent the flap from interfering with the packing of the insert into the envelope body. For example, if the insert contacts the envelope flap during packing, the insert may catch on the flap and cause fouling of the system. Current envelope packing systems control the flap by covering the flap with a flap control feature, such as a plate, finger, or guide, during the packing phase. However, mechanical hold-downs interfere with smooth transition of the insert material into the envelope. In addition, the varying nature of envelope styles and sizes results in limited success when applying a mechanical hold-down mechanism.

A problem associated with these types of flap control features, however, is these conventional flap control features can interfere with other portions of the envelope packing system. For example, in a continuous envelope packing system in which the envelope remains moving during the packing phase, conventional flap control features cannot cover the flap at all times for all types of envelope sizes and construction types without interfering with other portions of the envelope packing system. Furthermore, although the crease in the envelope has been substantially flattened, the envelope may still retain a bias to return to the flap-closed configuration, and if this occurs, the flap may prevent a pusher mechanism from packing the insert into the envelope body. Accordingly, a needs exists for a device and method for improved control of a flap on an envelope that minimizes interference with other portions of the envelope packing system.

SUMMARY

This and other needs are met, for example, by a high-speed envelope transport and packing system comprising a conveyor for conveying an open envelope having a flap, a packing station for inserting an object into a conveyed open envelope, and a bending member disposed upstream of the packing station. The bending member is configured to impart a bend in a conveyed open envelope by displacing a center portion of the open envelope relative to widthwise distal end portions of the conveyed open envelope and to maintain a bend in a conveyed open envelope until the open envelope is gripped by a gripping device in such a manner as to provide access to an interior of the open envelope or until an object is at least partially inserted into an interior of the open envelope.

In another aspect, a high-speed envelope transport and packing system in accord with the present disclosure comprises a bending member configured to bend a conveyed envelope about the z-axis during conveyance of the conveyed envelope to increase the moment of inertia of the conveyed envelope about the z-axis above a corresponding moment of inertia of the conveyed envelope in a flat state.

In still another aspect, a high-speed envelope transport and packing system comprises a conveyor for conveying an open envelope having a flap, a packing station for inserting an object into a conveyed open envelope, and a vacuum plate provided in the packing station. The vacuum plate is configured to slidingly secure an envelope and an envelope flap against the vacuum plate, at least during insertion of an object into the conveyed open envelope.

In yet another aspect, a high-speed envelope transport and packing system comprises a conveyor for continuously conveying a plurality of open envelopes, a packing station for inserting an object into a respective one of the plurality of continuously conveyed open envelopes, and a vacuum plate provided in the packing station. The vacuum plate is configured to slidingly secure the plurality of continuously conveyed open envelopes including envelope flaps thereof against the vacuum plate at least during insertion of an object into each of the continuously conveyed open envelopes.

In still another aspect, a high-speed envelope transport and packing system comprises a conveyor for continuously conveying a plurality of open envelopes, a packing station for inserting an object into a respective one of the plurality of continuously conveyed open envelopes, and a means for controlling a flap of each of the continuously conveyed open envelopes during insertion of an object into each of the envelopes in the packing station.

Additional advantages will become readily apparent to those skilled in the art from the following detailed description, wherein only an exemplary embodiment is shown and described, simply by way of illustration. As will be realized, the disclosed technology is capable of other and different embodiments, and its several details are capable of modifications in various obvious respects. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION

Figure 1:
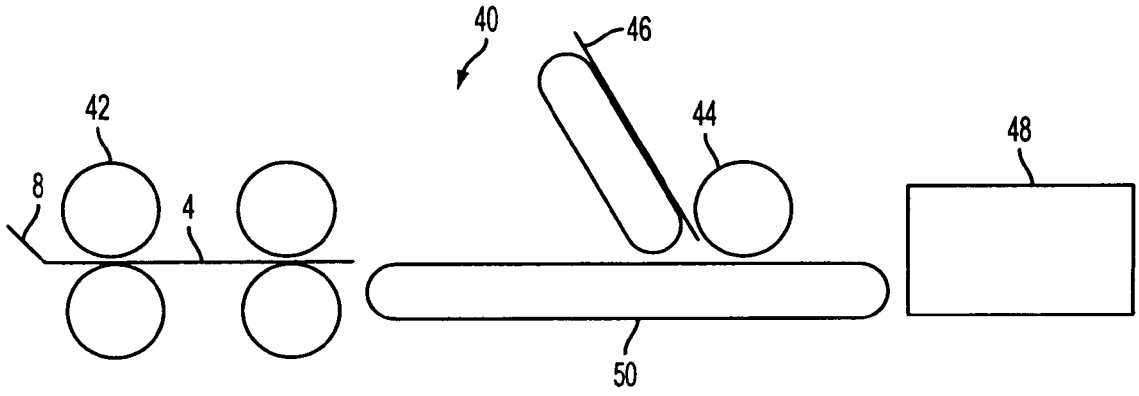
FIG. 1 is a highly schematic side view of a conventional high speed envelope transport and packing system.
Figure 2:
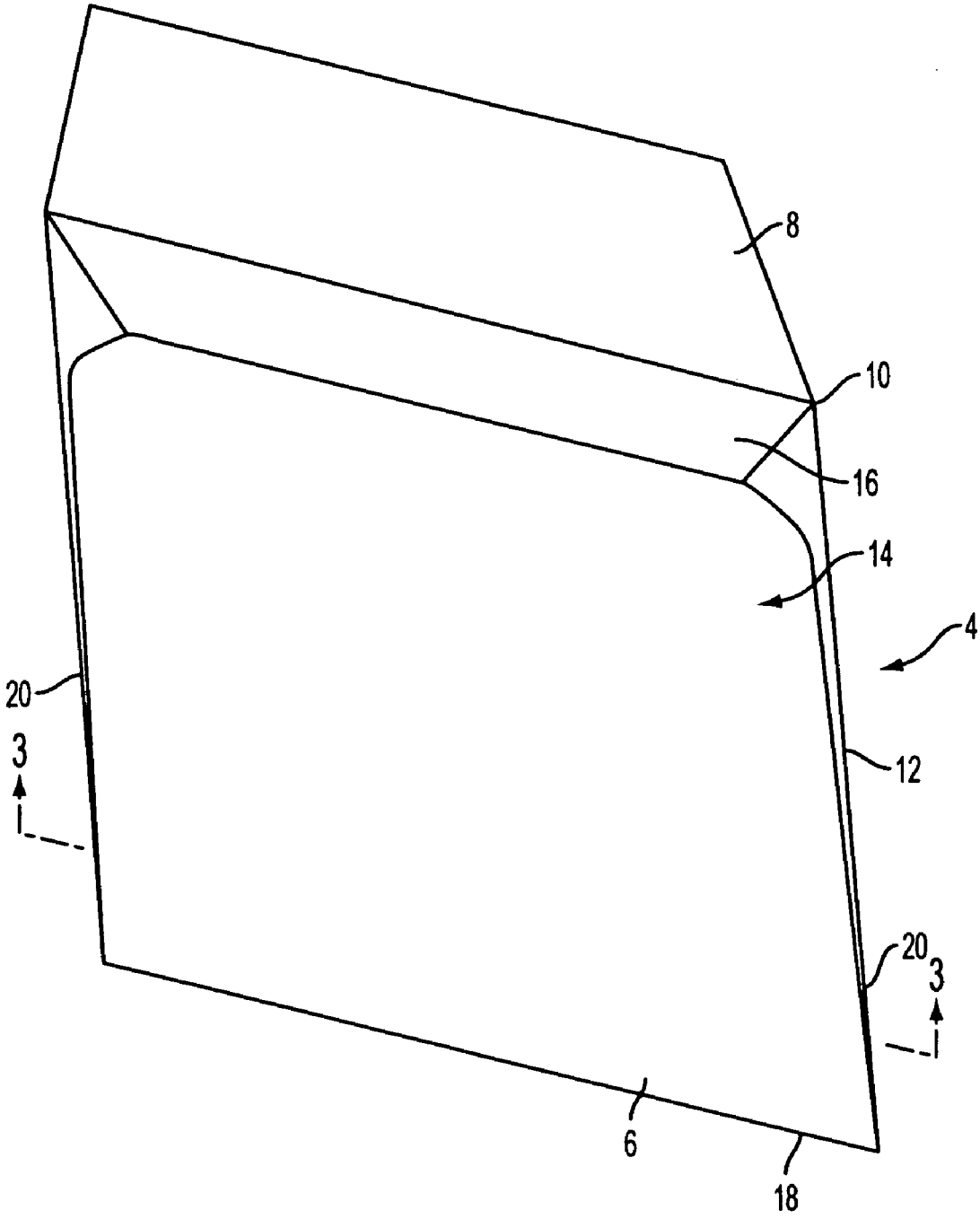
FIG. 2 is a substantially schematic perspective of an envelope.
Figure 3A:
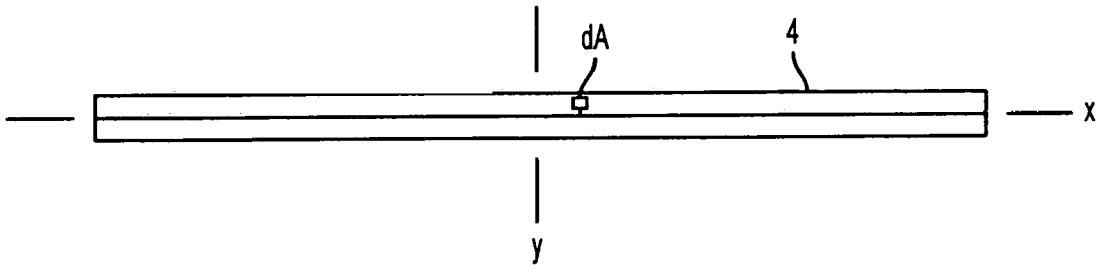
FIGS. 3A and 3B are respective cross sections of a flat envelope and a bent envelope.
Figure 3B:
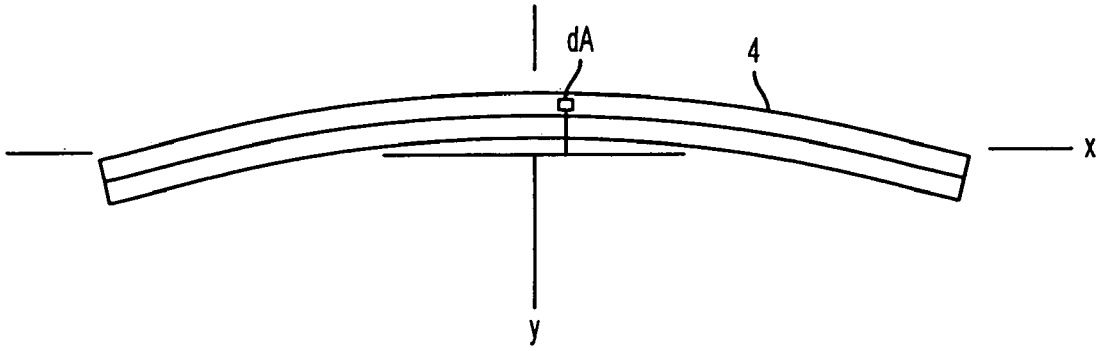

The present subject matter improves control of a flap on an envelope in an envelope packing or inserting system by bending the envelope about an axis that is substantially perpendicular to a connecting edge between the flap and an envelope body of the envelope. FIGS. 3A and 3B respectively illustrate the cross-sections of an envelope when the envelope is flat and when the envelope is bent. These cross-sections are taken along a x-axis, which is substantially parallel to the connecting edge of the envelope.

The term "moment of inertia" (or second moment) refers to a characteristic of a body that represents that body's resistance to bending. The equation used to calculate the moment of inertia for a body with respect to a particular axis is given as follows:

$$I_x = \int_A y^2 dA$$

$I_x$ is moment of inertia about an x-axis, dA is an area of an element, and y is a perpendicular distance of dA from axis X.

When the envelope 4 is bent (either up or down) about a z-axis (not shown, but which is perpendicular with the page illustrating FIG. 3B and substantially perpendicular to the connecting edge), although the cross-sectional area A of the bent envelope remains the same as the cross-sectional area A of the flat envelope, the moment of inertia $I_x$ of the envelope bent about the z-axis is greater than the moment of inertia $I_x$ of the flat envelope (FIG. 3A). This difference is readily apparent from the above-reproduced equation. In the flat envelope, the distances y from the x-axis to various elements dA are all relatively small. In the envelope bent about the z-axis, although some of the distances y from the x-axis to various elements dA are the same as in the flat envelope, for other elements dA, the distances y from the x-axis are considerably larger. This results in a moment of inertia $I_x$ of the envelope bent about the z-axis being greater than the moment of inertia $I_x$ of the flat envelope.

As a result of this greater moment of inertia $I_x$ along the x-axis, the envelope that is bent about the z-axis has a greater ability to resist bending about the x-axis than that of the flat envelope. As the x-axis illustrated in FIG. 3B is substantially parallel to the connecting edge of the envelope, the envelope that is bent about the z-axis similarly has a greater ability to resist bending about the connecting edge of the envelope than that of the flat envelope, and as previously stated, the z-axis is substantially perpendicular to the connecting edge. Thus, control of the flap of the envelope can be improved by bending the envelope about an axis that is substantially perpendicular to a connecting edge of the envelope.

Although not limited in this manner, the direction of travel of the envelope through the envelope packing system is generally substantially perpendicular to the connecting edge of the envelope. As such, the axis about which the envelope is bent to control the flap is generally substantially parallel to the direction of travel of the envelope through the envelope packing system.

Figure 4A:
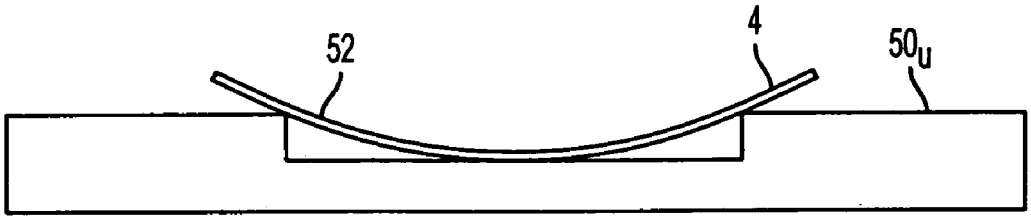
FIGS. 4A and 4B are cross sections of conveyors that bend an envelope upward in accord with the present concepts.
Figure 4B:
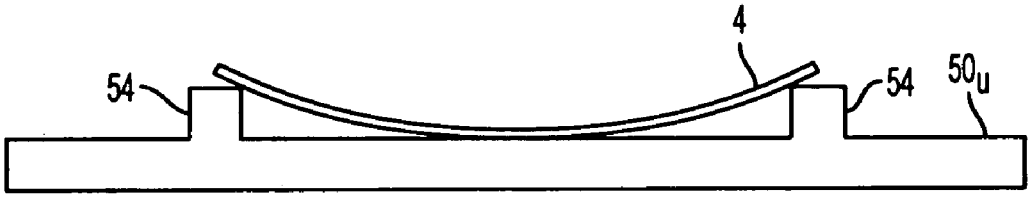
Figure 5A:
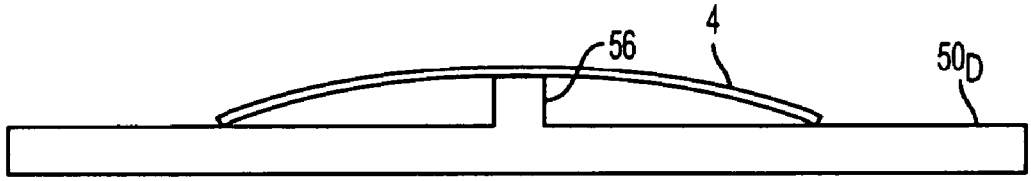
FIGS. 5A and 5B are cross sections of conveyors that bend an envelope downward in accord with the present concepts.
Figure 5B:
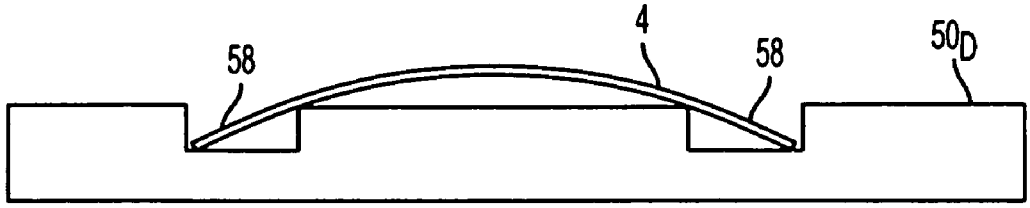

As previously discussed, the control of the flap of the envelope can be improved by bending the envelope either upward or downward, and the envelope packing system is not limited in the manner in which the bending is accomplished. For example, as illustrated FIG. 4A, an envelope 4 can be bent upward by placing a center portion of the envelope 4 in a channel 52 of a conveyor 50*u*, or as illustrated in FIG. 4B, the envelope 4 can be bent upward using a pair of rails 54 located at opposite ends of the conveyor 50*u*. Alternatively, in FIG. 5A, the envelope 4 can be bent downward using a single rail 56 positioned approximately at the center of the envelope 4, or in FIG. 5B, the envelope 4 can be bent downward using a pair of channels 58 located at opposite ends of the conveyor $\mathbf{50}_D$. The rails 54, 56, although shown connected to the conveyor 50, are not limited in this manner and can be positioned away from the body of the conveyor 50.

Figure 6:
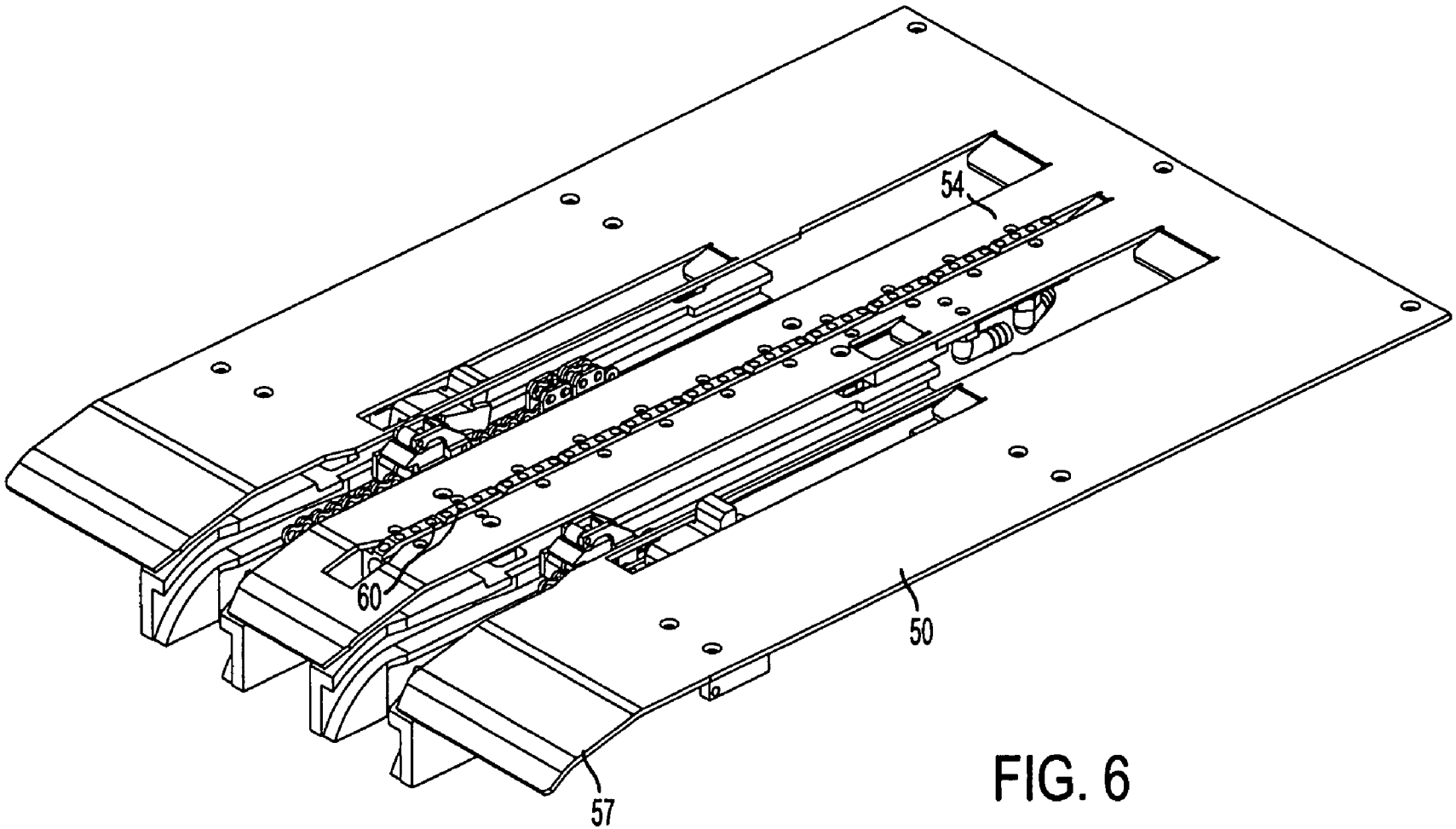
FIG. 6 is a perspective of a conveyor in accord with the present concepts.

In a certain embodiment of the envelope packing system, as illustrated in FIG. 6, the conveyor 50 includes a single rail 54 positioned substantially along a longitudinal axis of the conveyor 50 and parallel to a direction of movement of an envelope 4 along the conveyor 50. This configuration is similar to that shown in FIG. 5A. Although not limited in this manner, the conveyor 50 can include vacuum ports 60 running along the length of the conveyor 50. As each envelope 4 is projected onto the conveyor 50, the envelope 4 lands upon a receiving portion 57 of the conveyor 50 and is then transported down the conveyor 50 at which time the vacuum ports 60 maintain each envelope 4 in substantial contact with the conveyor 50.

The conveyor 50 depicted in FIG. 6 comprises a packing station wherein an object or packet, broadly characterized as insertion materials, may be inserted into a conveyed open envelope 4. The packing station comprises the portion of the conveyor which includes the single rail 54. The rail 54 is configured to impart a bend in a conveyed open envelope 4 by displacing a center portion of the open envelope relative to widthwise distal end portions of the open envelope and to maintain a bend in the conveyed envelope until the envelope is gripped by a gripping device (not shown) in such a manner as to provide access to an interior of the envelope or until an object is at least partially inserted into an interior of the envelope.

In a continuous motion mail inserting system, the envelope and the insertion materials are in simultaneous, same direction motion during insertion of the insertion materials. For example, the insertion materials may be disposed to travel in the same direction as the open envelope 4 with the open end of the envelope facing the downstream side. The insertion materials are given a velocity slightly greater than that of the envelope to enable the insertion materials to overtake the open envelope. To ensure proper packing of insertion materials in the envelope 4, a slight force in a direction opposite to the direction of travel of the envelope 4 can be provided across the full length of the conveyor 50 to counterbalance the force generated by the packing of the insert material into the envelope 8. This slight force may be generated by frictional forces, which may be enhanced by the use of vacuum ports 60. Thus, in addition to simply retaining envelope 4 against the conveyor 50, the vacuum ports 60 can also provide or contribute to the desired counterbalancing force in a direction opposite to the direction of travel of the envelope 6 by increasing a frictional force generated between the envelope 4 and the conveyor 50.

The conveyor 50 is not limited as to the height above the surface of the conveyor 50 that the rail 54 extends. For example, tests have shown that the rail 54 can have a height of up to 5.0 mm above the surface of the conveyor 50. However, increasing the height of the rail 54 makes it more difficult to open the envelope opening 16 during the insertion process. It has been found that a range of height from about 1.25 mm to about 1.75 mm provides a good balance between controlling the flap 8 and opening the envelope opening 16, and in certain aspects of the envelope packing system, the height of the rail 54 can be set to about 1.5 mm.

The envelope packing system is not limited as to the size, number, or pattern of vacuum ports 60 located in the conveyor 50. For example, depending upon the type of envelope to be packed, the size, number, and/or pattern of vacuum ports 60 to be used may vary. As such, a single envelope packing system may be limited to only a certain type of envelope. Alternatively, the envelope packing system may include a conveyor 50 having vacuum ports 60 that are adjustable as to size, number, and/or pattern of ports.

Figure 7:
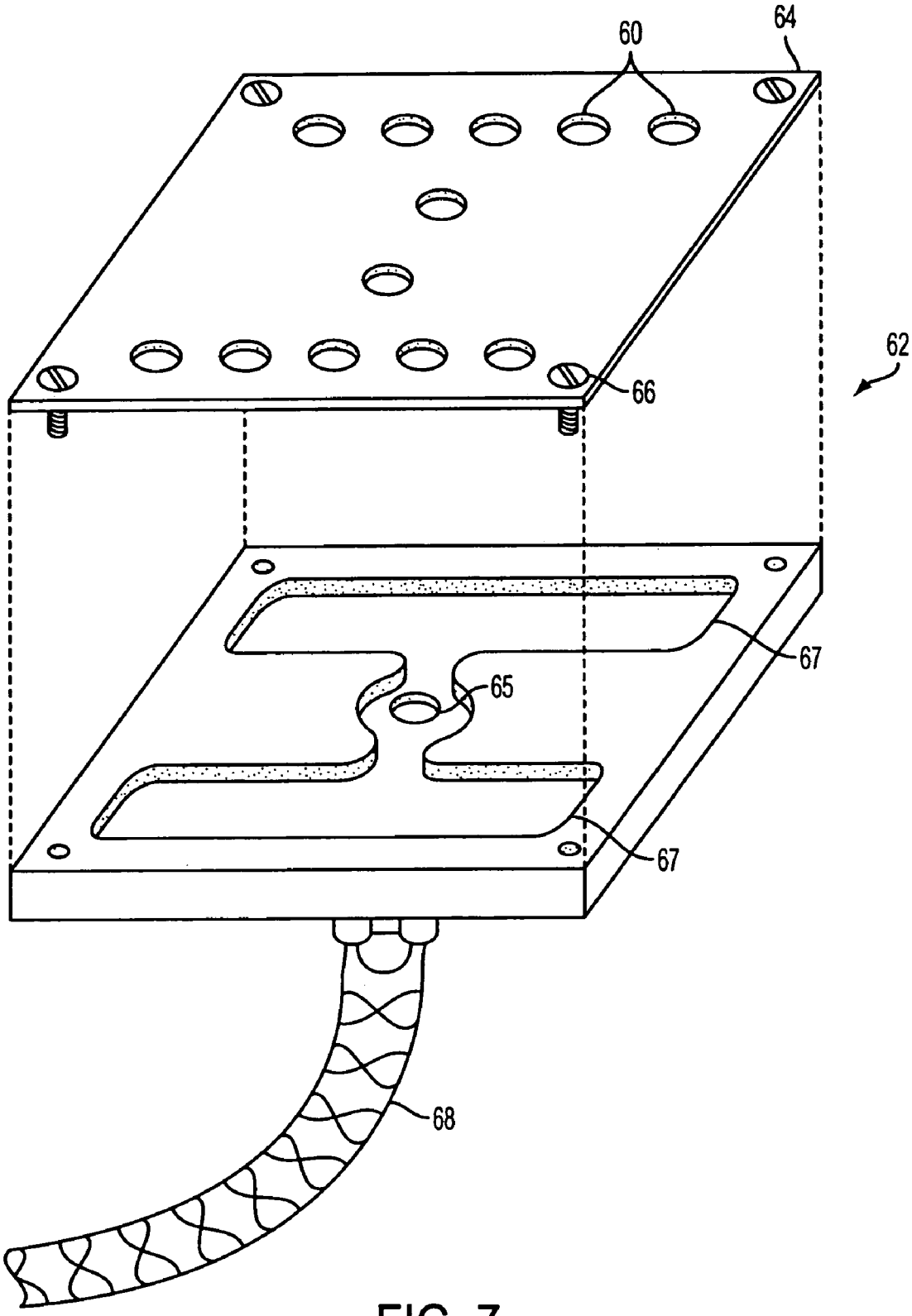
FIG. 7 is an exploded perspective of a vacuum manifold in accord with the present concepts.

As illustrated in FIG. 6, the pattern of vacuum ports 60 can be a single line parallel to the direction of the path of the envelope 4 through the conveyor 50. Another alternative is shown in FIG. 7, which combines two lines of vacuum ports 60 that are parallel to the direction of the path of the envelope 4 through the conveyor 50 with one or more staggered lines of vacuum ports 60 that are perpendicular to the direction of the path of the envelope 4 through the conveyor 50. The plate 64 may be curved to force the envelope to assume the shape or orientation shown by way of example in FIG. 3B-5B.

The plate of FIG. 6 significantly provides a separate and independent form of envelope control obviating the need to bend the envelope, as previously described. The vacuum ports 60 may be adapted to slidingly retain the envelope and the flap securely against the plate 64 while the insertion materials are directed into the interior of the envelope. The vacuum ports 60 would need to develop sufficient vacuum to secure the flap by overcoming the spring tension produced by the fold crease. In this way, the flap is assuredly not in the path of the insertion materials during the insertion process. As previously discussed, the invention is not limited as to a particular type of pattern, and the patterns shown in FIGS. 6 and 7 are only but two possible examples of patterns of vacuum ports 60.

The envelope packing system is also not limited as to the manner in which the vacuum ports 60 can be adjusted as to size, shape, number, and/or pattern of ports. For example, the conveyor 50 can include a sufficient number of vacuum ports 60 capable of reproducing all desired numbers and/or patterns of desired vacuum ports 60. The vacuum ports 60 can the be controlled individually or in combination, for example, by a system of valves, to open or close the vacuum ports 60. By selectively controlling the valves, any desired number and/or pattern of active vacuum ports 60 can be obtained. Furthermore, the size and/or shape of the vacuum ports 60 can be modified, for example, with inserts than can be placed inside the vacuum ports 60. Each insert can have a different size and/or shape of hole than the vacuum port 60 into which the insert is placed thereby changing the size and/or shape of the vacuum port 60.

Another example in which the size, shape, number, and/or pattern of vacuum ports 60 can be modified using removable manifolds is illustrated in FIG. 7. Each of the one or more manifolds 62 can include a particular size, shape, number, and/or pattern of vacuum ports 60, and by replacing the one or more manifolds 62 within the conveyor 50, the size, shape, number, and/or pattern of vacuum ports 60 can be modified. Although each manifold 62 can be dedicated to a particular size, shape, number, and/or pattern of vacuum ports 60, the envelope packing system is not limited in this manner. For example, each manifold 62 can include one or more removable plates 64 that each include a particular size, shape, number, and/or pattern of vacuum ports 60. Thus, by replacing only the plate 64, instead of the whole manifold 62, the size, shape, number, and/or pattern of vacuum ports 60 can be modified.

If a manifold 62 includes a plate 64, the envelope packing system is not limited as to particular manner in which the plate 64 is secured to the manifold 62. For example, the plate 64 and the manifold 62 can be secured together using a magnetic connection. As another example, the plate 64 and the manifold 62 can be secured together using screws 66. Although not limited in this manner, each manifold 62 can include a separate channel/hose 68 that fluidly connects the vacuum ports of the manifold 62 to a vacuum source via a central opening 65 connected to channels 67 in the manifold 62 adjacent the vacuum ports 60. Alternatively, each manifold 62 can share a connection to the vacuum source.

Figure 8A:
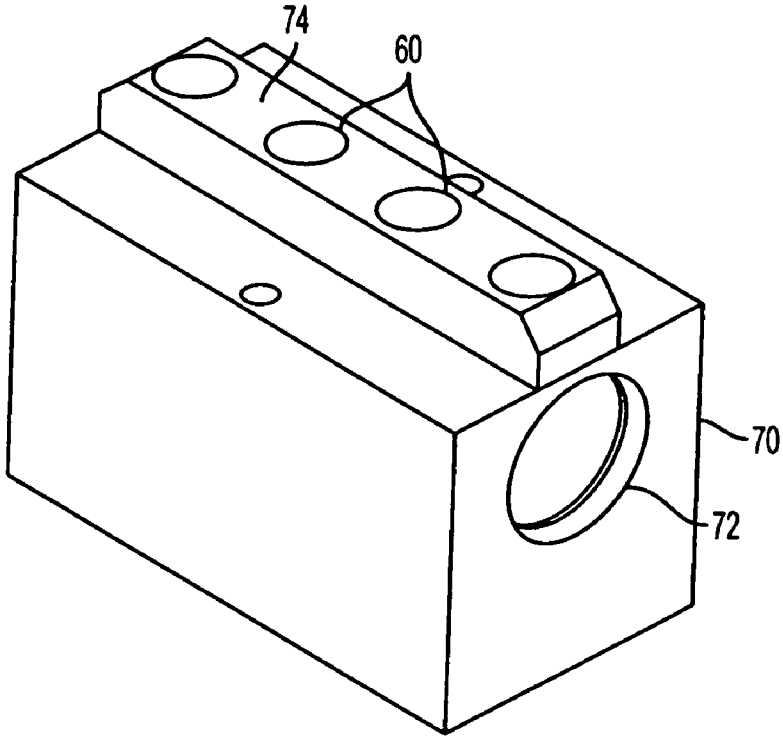
FIGS. 8A and 8*b* are perspectives of manifolds in accord with the present concepts.
Figure 8B:
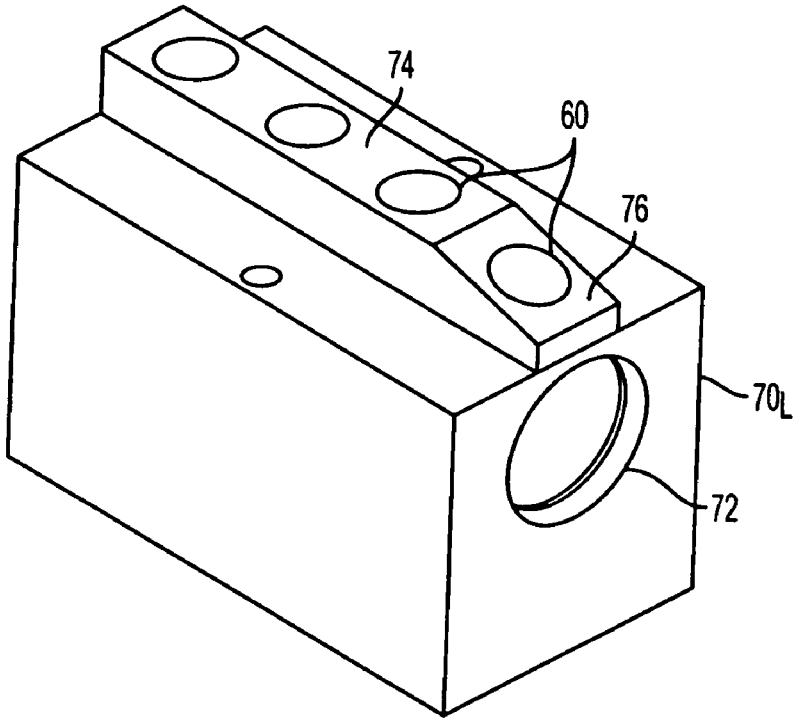

An example of manifolds 70 according to one aspect of the envelope packing system is illustrated in FIGS. 8A, 8B. Furthermore, referring to FIG. 6, a number of the manifolds 70 can be combined longitudinally to form the rail 54. Each manifold 70 contains one or more vacuum ports 60 positioned along at least one face 74 of the manifold 70. Each vacuum port 60 is also fluidly connected to a channel 72 having at least one opening. When multiple manifolds 70 are positioned end-to-end, as shown in FIG. 6, the openings of the channels 72 in adjacent manifolds 70 mate to form a shared connection, and this shared connection can be connected to a vacuum source. In addition, each of the manifolds 70 can include an opening at the bottom of the manifold 70 that can allow for separate connection to the vacuum source.

FIG. 8B illustrates an example of a leading manifold $\mathbf{70}_L$. In contrast to the manifold 70 illustrated in FIG. 7A, which has a substantially flat surface 74 on which the vacuum ports 60 are positioned, the leading manifold $70_L$ includes an angled leading edge 76 that can also include one or more vacuum ports 60. Referring again back to FIG. 6, the upper portions of the manifolds 70 extend over the top surface of the conveyor 50 to serve as the rail 54. The angled leading edge 76 advantageously provides a smooth transition from the top surface of the conveyor 50 near the receiving portion 57 of the conveyor 50 to the substantially flat surfaces 74 of the downstream manifolds 70 from the leading manifold $70_L$. Otherwise, if a smooth transition was not provided, an envelope 4 could become hung up on the leading edge of the leading manifold $70_L$.

The present concepts can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding. However, it should be recognized that the concepts outlined above can be practiced without resorting to the details specifically set forth. In other instances, well known processing structures have not been described in detail, in order not to unnecessarily obscure the present concept. It is to be understood that the present concepts are capable of application in various other combinations and environments and are capable of changes or modifications within the scope of the inventive concept as expressed herein.

What is claimed:

1. A high-speed envelope transport and packing system comprising:

a conveyor for conveying an open envelope having a front wall, a back wall and a flap extending away from the front wall, a packing station for inserting an object into the conveyed open envelope, such that the conveyed open envelope and the object are in simultaneous, same direction motion along the conveyor during insertion of the object into the conveyed open envelope; and a bending member disposed in the packing station;

wherein the bending member is configured to impart a bend in the conveyed open envelope by displacing a center portion of the conveyed open envelope and to maintain the bend in the conveyed open envelope until the open envelope is gripped by a gripping device, in such a manner as to provide access to an interior of the open envelope or until the object is at least partially inserted into an interior of the open envelope, wherein a joint between the flap and the open envelope is perpendicular to the conveyor, and wherein the bending member is configured to bend the open envelope about an axis that is substantially perpendicular to the joint between the flap and the open envelope.

2. A high-speed envelope transport and packing system according to claim 1, wherein the bending member comprises a rail disposed along a direction of conveyance of the open envelope in a position substantially corresponding to a center line of the conveyed open envelope with respect to a widthwise direction of the conveyed open envelope.

3. A high-speed envelope transport and packing system according to claim 2, wherein the rail comprises a plurality of vacuum ports.

4. A high-speed envelope transport and packing system according to claim 3, wherein the rail disposed along a direction of conveyance of the open envelope is disposed proximal to a side of the conveyed open envelope having the flap.

5. A high-speed envelope transport and packing system according to claim 4, wherein a front edge of the rail, relative to the direction of conveyance of the open envelope, is chamfered or curved.

6. A high-speed envelope transport and packing system according to claim 5, wherein the rail comprises a plurality of linearly arranged vacuum port manifolds, each vacuum port manifold comprising a plurality of vacuum ports.

7. A high-speed envelope transport and packing system according to claim 6, wherein front edges of the vacuum port manifolds, relative to the direction of conveyance of the open envelope, are chamfered or curved.

8. A high-speed envelope transport and packing system according to claim 2, wherein a height of the rail is less than about 5.0 mm.

9. A high-speed envelope transport and packing system according to claim 2, wherein a height of the rail is between about 1.25 mm and 1.75 mm.

10. A high-speed envelope transport and packing system according to claim 1, wherein the at least one bending member comprises paired rails disposed along a direction of conveyance of the open envelope in positions substantially equidistant to a center line of a conveyed open envelope with respect to a widthwise direction of the conveyed open envelope.

11. A high-speed envelope transport and packing system according to claim 10, wherein each of the paired rails comprises a plurality of vacuum ports.

12. A high-speed envelope transport and packing system according to claim 11, wherein one of the rails disposed along a direction of conveyance of the open envelope is disposed proximal to a side of the conveyed open envelope having the flap.

13. A high-speed envelope transport and packing system according to claim 12, wherein front edges of the rails, relative to the direction of conveyance of the open envelope, are chamfered or curved.

14. A high-speed envelope transport and packing system according to claim 10, wherein a height of the rails is less than about 5.0 mm.

15. A high-speed envelope transport and packing system according to claim 10, wherein a height of the rails is between about 1.25 mm and 1.75 mm.

16. A high-speed envelope transport and packing system according to claim 1, wherein the bending member comprises a channel disposed along a direction of conveyance of the open envelope in a position substantially corresponding to a central region of the conveyed open envelope with respect to a widthwise direction of the conveyed open envelope.

17. A high-speed envelope transport and packing system according to claim 16, wherein a width of the channel is greater than about half of a width of the conveyed open envelope with respect to the widthwise direction of the conveyed envelope.

18. A high-speed envelope transport and packing system according to claim 16, wherein a width of the channel is greater than about three-quarters of a width of the conveyed open envelope with respect to the widthwise direction of the conveyed open envelope.

19. A high-speed envelope transport and packing system according to claim 1, wherein the bending member comprises paired channels disposed along a direction of conveyance of the open envelope in positions substantially equidistant to a center line of a conveyed open envelope with respect to a widthwise direction of the conveyed open envelope, and wherein the paired channels are disposed to receive widthwise ends of the conveyed open envelope.

20. A high-speed envelope transport and packing system according to claim 1, further comprising:

a vacuum plate provided in the packing station;

wherein the vacuum plate is configured to bias an envelope and an envelope flap against the vacuum plate at least during insertion of an insert into the conveyed open envelope.

21. A high-speed envelope transport and packing system according to claim 20, wherein the vacuum plate comprises a plurality of vacuum ports extending widthwise across a portion of the packing station corresponding to a conveyed open envelope.

22. A high-speed envelope transport and packing system according to claim 20, wherein the vacuum plate is removably attached to the packing station.

23. A high-speed envelope transport and packing system according to claim 20, wherein the vacuum plate is provided within a central region of the packing station corresponding to a central portion of a conveyed open envelope.

24. A high-speed envelope transport and packing system according to claim 20, wherein the conveyor continuously conveys a plurality of open envelopes, wherein the vacuum plate is configured to bias each of the plurality of continuously conveyed open envelopes, as well as associated envelope flaps thereof, against the vacuum plate at least during insertion of an insert into the respective one of the continuously conveyed open envelopes.

25. In a high-speed envelope transport and packing system, the improvement comprising:

a bending member configured to bend a conveyed envelope about the z-axis during conveyance of the conveyed envelope to increase the moment of inertia of the conveyed envelope about the z-axis above a corresponding moment of inertia of the conveyed envelope in a flat state, said moment of inertia defined as the conveyed envelope's resistance to bending, wherein the conveyed envelope includes a front wall, a back wall and a flap extending away from the front wall, wherein the bending member is configured to bend the front wall, back wall and flap of the conveyed envelope about an axis that is substantially perpendicular to a joint between the flap and the conveyed envelope.

26. The improvement in a high-speed envelope transport and packing system according to claim 25, wherein the bending member comprises at least one of a center rail, a plurality of rails, a curved plate, a center channel, and a plurality of channels disposed along at least one side of a conveyed envelope, and wherein the bending member is configured to displace a central portion of the conveyed envelope by less than about 5.0 mm relative to widthwise ends of the conveyed envelope.

* * * * *